United States Patent [19]

Bifano et al.

[11] Patent Number: 5,063,720

[45] Date of Patent: Nov. 12, 1991

[54] PVC UNIT ASSEMBLY JOINTS

[75] Inventors: Gabriel F. Bifano, Miami; Erenio Reyes, Hialeah, both of Fla.

[73] Assignee: Vinyl Corporation, Miami, Fla.

[21] Appl. No.: 517,652

[22] Filed: Apr. 30, 1990

[51] Int. Cl.[5] ..... E04B 1/41

[52] U.S. Cl. ..... 52/309.1; 52/366; 52/741; 156/258

[58] Field of Search ..... 52/309.1, 741, 255, 52/256, 257, 254, 364; 156/258

[56] References Cited

U.S. PATENT DOCUMENTS

| | | | |
|---|---|---|---|
| 641,670 | 1/1990 | Blazo . | |
| 1,100,531 | 6/1914 | Cahill . | |
| 1,169,066 | 1/1916 | Carrick . | |
| 1,209,151 | 12/1916 | Hartman . | |
| 1,282,592 | 10/1918 | Knapp . | |
| 1,592,591 | 7/1926 | Amele . | |
| 1,851,452 | 3/1932 | Sherry . | |
| 2,616,145 | 11/1952 | Dufford . | |
| 2,748,443 | 6/1956 | Dufford . | |
| 2,807,070 | 9/1957 | Thomas . | |
| 2,906,692 | 9/1975 | Boiardi . | |
| 3,201,908 | 8/1965 | Arnold | 52/255 |
| 3,345,789 | 10/1967 | Tatum . | |
| 3,667,174 | 6/1972 | Arnett | 52/364 |
| 4,793,586 | 12/1988 | Buss . | |
| 4,798,364 | 1/1989 | Scott . | |

*Primary Examiner*—John E. Murtagh

*Attorney, Agent, or Firm*—Foley & Lardner

[57] ABSTRACT

A joint assembly forming part of a gridwork of channel sections used as decorative partitions in various types of wall construction, the joint assembly including abutting, mitered channel sections, adhesive tape backing, and adhesive glue for bonding the abutting channel sections together and, additionally, a method of assembling said joint assemblies using adhesive tape backing and adhesive glue for bonding the sections together.

28 Claims, 4 Drawing Sheets

PVC UNIT ASSEMBLY JOINTS

TECHNICAL FIELD

The present invention relates to construction materials and, more particularly, to channel screed used for providing aesthetically pleasing breaks or partitions in walls. Such channel screed is often used in conjunction with stucco surfaces or drywall. More particularly still, the present invention relates to channel screed joints and an improved method for assembling various sections of channel screed, or other material, into prefabricated joints.

BACKGROUND OF THE INVENTION

Channel type screed, used in the construction of walls, is known. See, for example, Knapp, U.S. Pat. No. 1,282,592, issued Oct. 22, 1918. Channel screed (partitions) in the surface material of walls are used for aesthetic purposes in the construction of wall surfaces. Screed can be used in building construction when the walls are covered with cement, mortar, plaster, stucco, drywall, etc. for partitioning the wall into segments of various size and shape. When using channel screed, the inside of the channel can then be painted or given a different texture to set it apart from the rest of the wall surface. This can give an otherwise homogenous surface a pleasing look and a new character.

Currently, channel screed is often made of aluminum and fastened together in various arrangements by either heliarc welds or cloth tape. Problems develop because the welds often are not water-tight, allowing damaging moisture to seep through the screed joints and into the wall. With cloth tape, the adhesive gradually fails, eventually letting water seep through the joints in the screed and collect behind the stucco or drywall, similarly damaging the walls.

Currently, channel screed is typically cut at the construction site, with the aid of jigs, to mate at intersections, thereby forming a joint. Such process requires that cutting equipment and appropriate jigs be transported to and set up at the job site. The process of cutting the channels while on the job site, in an attempt to form properly mating joint sections, is time consuming and difficult. Difficulty also arises in forming a tight joint between intersecting screed channels. A loose joint between intersecting screed channels usually results in a joint which may not be water-tight.

SUMMARY OF THE INVENTION

The present invention provides joints which restrict leakage through the joint and also a method for forming such joints so that forming joints in the field is not necessary. The joint assembly includes a set of mitered channel screed sections and an adhesive tape backing. Glue or some similar adhesive rigidly binds the mitered channel screed sections together.

The method for forming the joints comprises the steps of mitering channel screed sections so they will properly abut, placing the sections in proper abutting relationship, applying adhesive tape to the back side of the abutting sections and applying glue or similar adhesive to obtain greater joint rigidity.

BRIEF DESCRIPTION OF THE DRAWING

A preferred exemplary embodiment of the present invention will hereinafter be described in conjunction with the appended drawing wherein like numerals denote like elements.

DETAILED DESCRIPTION OF THE PREFERRED EXEMPLARY EMBODIMENT

Figure 1:
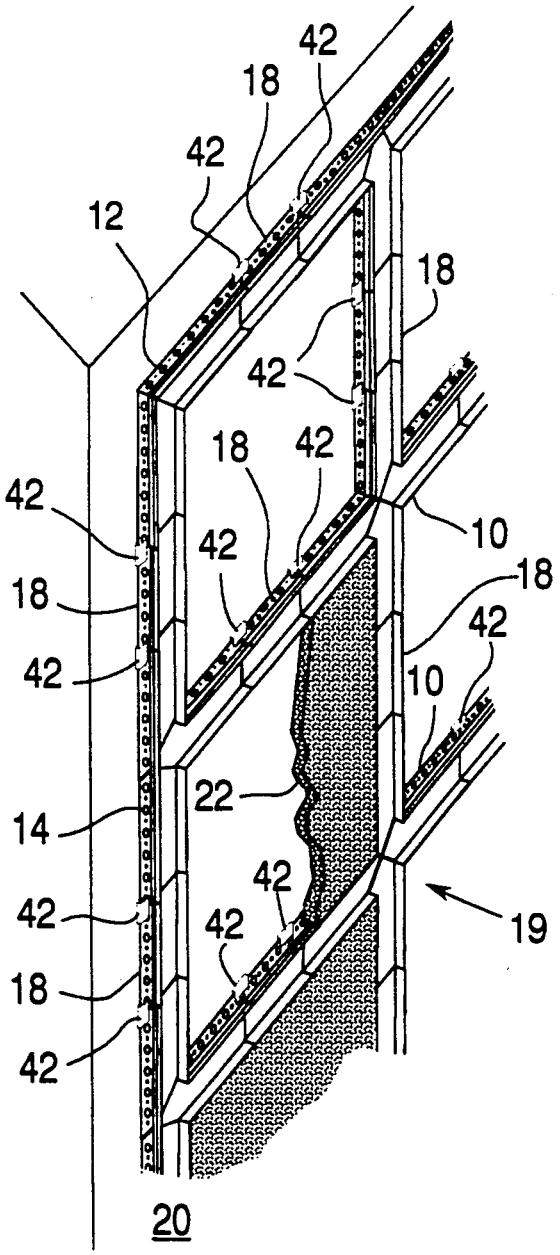
FIG. 1 is a view of a wall surface including a channel screed gridwork connected by various types of joints.

Referring to FIG. 1, a channel screed gridwork 19, comprising a plurality of PVC unit assembly joints, described in detail below, is shown mounted on a wall surface base 20. The gridwork of PVC plastic channels can be used for decoratively partitioning wall surfaces such as a stucco surface 22. However, drywall and many other surfaces can also be used in conjunction with the gridwork of PVC channels 19. The PVC unit assembly joints, including, inter alia, a crossjoint 10, an L-joint 12, and a T-joint 14, connect respective straight channel screed sections 18 to form channel screed gridwork 19. Respective splice connectors 42 connect the various joints and straight sections in gridwork 19. By way of example, one type of PVC plastic which may be used for the joints and straight channels is BF Goodrich Geon vinyl.

The respective joints of the gridwork, including T-joints 14, L-joints 12, cross-joints 10, etc., are preassembled in a central location and shipped to the construction site ready for attachment to surface base 20. PVC channel sections are appropriately cut to be fitted together in the form of a desired joint. A backing 36, suitably formed of UL rated foil tape, is then attached across a back surface 40 and a hot melt glue 38 is applied to the corners of the joint. Backing 36 and hot melt glue 38 firmly bond the PVC channel sections together while tightly sealing the joint to prevent moisture from seeping through the joint.

Figure 2:
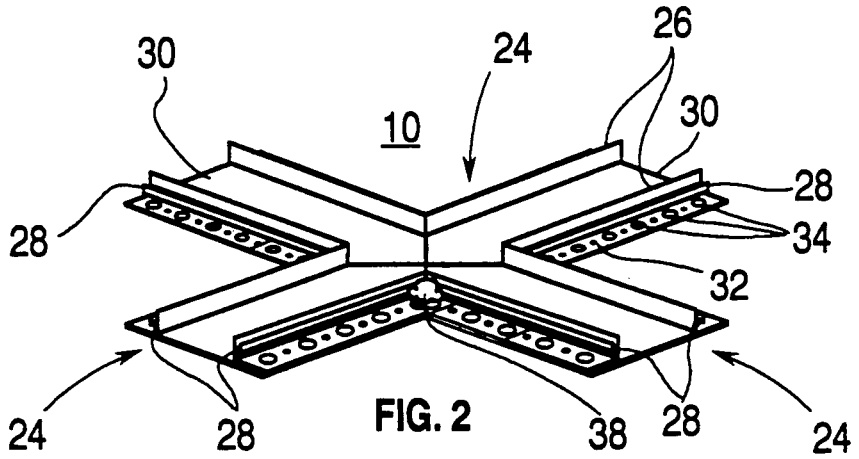
FIG. 2 is a perspective view of a cross-joint.
Figure 3:
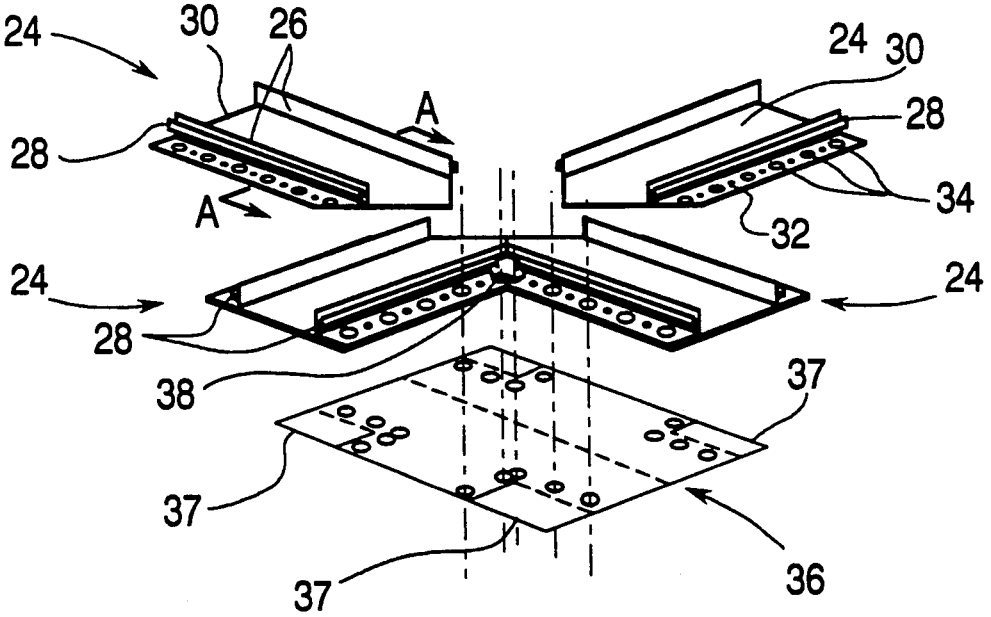
FIG. 3 is an exploded perspective view of a cross-joint.
Figure 5:
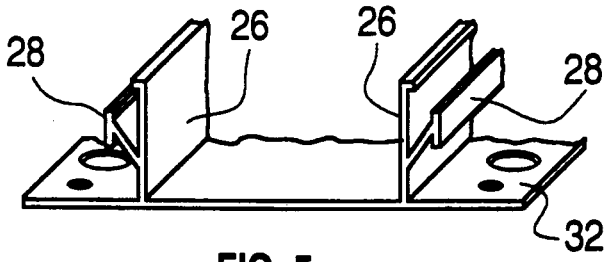
FIG. 5 is a side view taken along A—A of FIG. 3.

Referring now to FIGS. 2, 3 and 5, a PVC unit assembly cross-joint 10 suitably includes respective mitered channel screed sections 24, sealing backing 36, and adhesive hot melt glue 38 for fastening mitered channel screed sections 24 together (Cross-joint 10 is shown as exemplary of the various types of PVC unit assembly joints.) Each mitered channel screed section 24 includes respective channel walls 26, a channel bottom 30, and respective channel flanges 32 including a plurality of holes 34. Respective anchoring hooks 28, if desired, may also be provided as shown in FIG. 5.

Referring now to FIG. 5, channel walls 26 perpendicularly intersect the front surface of channel bottom 30 and channel flanges 32. Flanges 32 extend outwardly from channel bottom 30 in generally the same plane as channel bottom 30. Anchoring hooks 28, if desired, are attached to the flange side of walls 26. Alternative forms of anchoring hooks may be employed. When a construction material, such as stucco, is used in conjunction with the PVC unit assembly joints, anchoring hooks 28 allow the material to flow around the hook and then hold the material when it sets. However, when using other types of construction materials, such as drywall, the PVC unit assembly joints would not include anchoring hooks 28.

The plurality of holes 34 located in channel flanges 32 can be used with appropriate fasteners, i.e., nails, screws, etc., to fasten gridwork 19 to a wall. However, it should be understood that there are other methods for fastening the gridwork to a wall and fastening of the PVC joints to a wall is not limited to this one method of fastening.

Figure 4A:
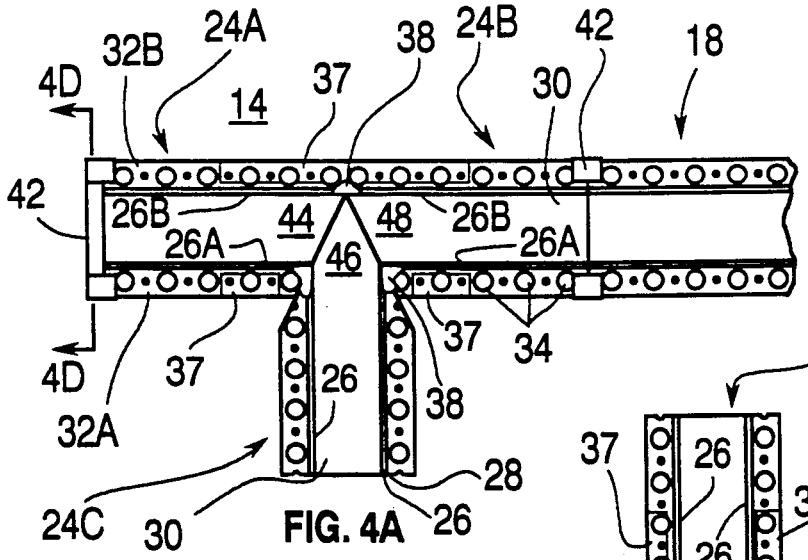
FIG. 4A is a front view showing a T-joint and connectors for connecting joints and straight channel sections.

The PVC unit assembly joints such as cross-joint 10 are connected to straight channel screed sections 18 by a splice connector 42 (FIG. 4D) as will be described. Splice connectors 42, shown in FIGS. 4A and 4D, are generally flat with ends 43 which extend around the exterior of channel flanges 32. Connectors 42 are disposed underlying the edges of the channel screed section ends of a joint, (e.g. joint 10), and an abutting joint or straight channel section 18 with the flanges 32 received under ends 43 of connector 42. The flat part of connector 42 lies along the back sides of the abutting channel sections, and the ends 43 extend around flanges 32 of the respective channel sections, thereby holding the various abutting sections of channel screed in linear communication.

PVC unit assembly joints can be provided in various configurations. Referring to FIG. 4A a set of three mitered channel screed sections 24A, 24B and 24C, are configured to form a T-joint 14. Portions having a predetermined configuration are removed from the abutting ends of sections 24A and 24B by suitably cutting the sections at an angle of 64 degrees from wall 26B of each section 24A and 24B. Each removed portion includes a portion of flange 32A, wall 26A and bottom 30 with the other wall 26B and flange 32B remaining intact. The removed portions form a generally V-shaped space between abutting sections 24A and 24B, suitably having an angle of approximately 52 degrees.

An end 46 is formed on section 24C by first cutting the section at an angle of 26 degrees from one channel wall 26 and then cutting the section at an angle of 26 degrees from the other channel wall such that the cuts intersect in the center of channel 24C. End 46 of section 24C is then received in the V-shaped space between abutting sections 24A and 24B, such that sections 24A, 24B, and 24C are joined at their respective mitered ends 44, 46, and 48 to fit in an abutting relationship. Wall 26 of each section 24 abut, forming either abutting corners or straight sections where glue is applied.

Figure 4B:
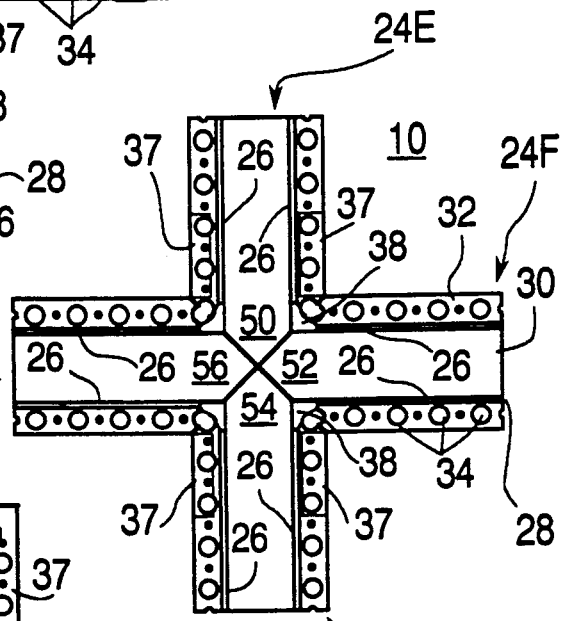
FIG. 4B is a front view showing a cross-joint.

Referring now to FIG. 4B, four mitered channel screed sections 24D, 24E, 24F, and 24G having ends cut to form V-shaped ends having angles of approximately 90 degrees are provided. The portions removed from each side of sections 24D, 24E, 24F, and 24G to form the V-shaped ends include a portion of one flange 32, one wall 26 and bottom 30. The sections 24D, 24E, 24F and 24G are thus mitered at angles so that their mitered ends fit in an abutting relationship. This relationship allows the channel screed sections 24D, 24E, 24F and 24G to extend in four directions forming a cross. Walls 26 of each section 24 abut, forming corners where glue may be applied.

Figure 4C:
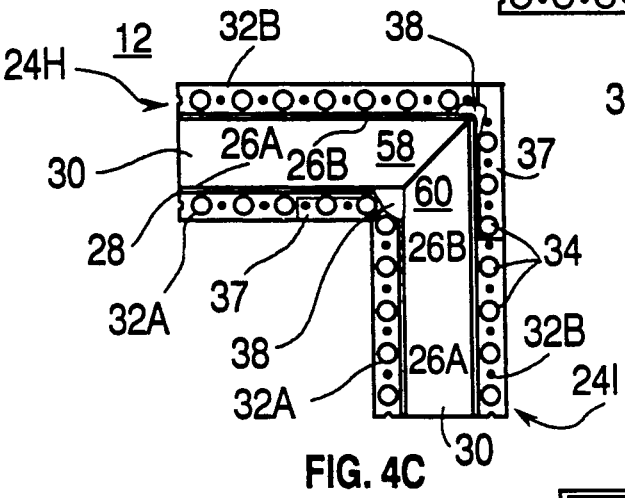
FIG. 4C is a front view showing an L-joint.
Figure 4D:
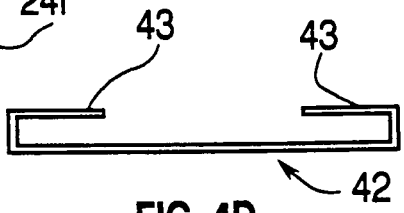
FIG. 4D is a cross sectional view of a splice connector.

Referring now to FIG. 4C, a set of two mitered channel screed sections, 24H and 24I are configured to form L-joint 12. Portions having a predetermined configuration are removed from sections 24H and 24I by cutting the sections at an angle of 45 degrees from wall 26B. Each removed portion includes a portion of flange 32A, wall 26A and bottom 30, with the other wall 26B and flange 32B remaining intact. Sections 24H and 24I are thus mitered so that their respective mitered ends 58 and 60 fit in an abutting relationship. This relationship allows channel screed sections 24H and 24I to extend in two directions forming a general L-shape.

Figure 6:
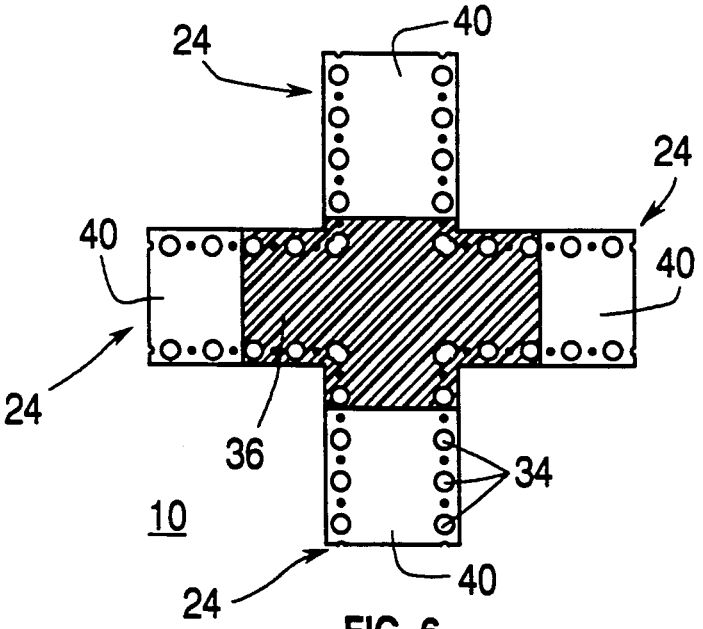
FIG. 6 is a back view showing the attached foil tape.

The respective mitered channel screed sections 24 are held in an abutting relationship and sealed by backing 36. Referring to FIG. 6, backing 36, preferably foil tape, adheres to back surface 40 of mitered channel screed sections 24. The respective edges 37 of backing 36 are folded over channel flanges 32. Use of such backing, and particularly foil tape, prevents moisture from seeping into the wall between potential gaps where mitered channel screed sections 24 abut one another. The backing 36 is preferably a UL rated water-proof and fire resistant foil tape, such as, for example, Ideal Tape Company UL 181A Foil Tape Number 487A.

As shown in FIGS. 2 and 4A–4C hot melt glue 38 is applied on the channel flange side of channel wall 26, to the corners where channel walls 26 of each mitered channel screed section 24 abut. Hot melt glue 38 bonds channel screed sections 24 together so that the joints are held securely together and can be safely transported to a prospective construction site. Furthermore, hot melt glue 38 assists in preventing moisture from seeping into the wall between potential gaps where mitered channel screed sections 24 abut one another as well as providing rigidity and strength to the joint so it will not break in transport or when fitting the joints into gridwork 19. By way of example only, hot melt glue 38 may be of the type Hot Glue Adhesive 3764-TC, manufactured by 3M Company.

The present invention also includes the method for making the PVC unit assembly joints. To avoid the problems mentioned previously, of cutting and forming joints at the construction site, PVC unit assembly joints can be fabricated at a central manufacturing location. Channel screed sections 24 are mitered in a consistent and uniform manner at the central manufacturing location and then bonded together with foil tape 36 and hot melt glue 38, thereby forming a water-tight joint.

Workers equipped with appropriate jigs miter the channel screed sections 24 more quickly and precisely than can be done in the field. Backing 36, e.g. foil tape, is then applied, suitably by hand. Subsequently, hot melt glue 38 is applied by appropriate methods such as hand-held hot melt glue guns. The resulting product is a prefabricated PVC screed channel joint which can be easily handled and shipped. These prefabricated joints can then be sent to a prospective construction site with corresponding straight channel screed sections 18 for easy installment on a wall such as wall 20.

The process of prefabricating PVC channel screed joints using backing 36 and hot melt glue 38 at a central location allows for a much better product that is easier to install. Backing 36 and hot melt glue 38 ensure that the joints are strong and water-tight, and prefabrication of the PVC joints at a central location provides a more precise, uniform product that is easier to install in the field.

It will be understood that the above description is of a preferred exemplary embodiment of the present invention, and that the invention is not limited to the specific forms or methods shown. For example, other suitable mechanisms may be employed to fasten the PVC unit assembly joints and remaining gridwork to a wall. By way of another example, other types of appropriate glues may be used in place of the hot melt glue. Also, anchoring hooks located on channel walls may not be necessary for some applications. Similarly, automated assembly techniques may be employed. Also, while the particular channel screed joint cross-section and configurations disclosed in the preferred embodiment are particularly advantageous, the apparatus and method of assembly is not limited in any way to such cross-section or configuration. The method of assembly will work for many other types of joints such as control joints and expansion joints. Various other substitutions, modifications, changes, and omissions may be made in the design and arrangement of the elements and method without departing from the spirit of the invention as expressed in the appended claims.

What is claimed is:

1. A screed joint assembly, comprising:

a first screed section and a second screed section, wherein each section includes a mitered end and the mitered end of the first section abuts the mitered end of the second section;

a backing adhered to the first and second screed sections sealing the junction between the screed sections; and means for bonding the first screed section to the second screed section.

2. The joint assembly of claim 1, wherein each screed section includes a channel bottom having a front surface and a back surface, a first channel wall extending from the front surface, and a second channel wall extending from the front surface.

3. The joint assembly of claim 2, wherein said backing comprises an adhesive tape adhered to the back surfaces of the screed sections.

4. The joint assembly of claim 1, wherein the backing comprises a water-proof foil tape.

5. The joint assembly of claim 1, wherein the means for bonding comprises a hot melt glue.

6. The joint assembly of claim 2, wherein the channel bottom of each screed section includes a first flange extending outwardly from the first channel wall and a second flange extending outwardly from the second channel wall, both flanges lying in the same plane as the channel bottom.

7. The joint assembly of claim 6, wherein the means for bonding comprises a hot melt glue applied to the screed sections substantially at the location where the screed sections abut.

8. The joint assembly of claim 6, wherein the adhesive tape is adhered to the back surfaces of the screed sections.

9. The joint assembly of claim 6, wherein the channel screed sections are formed from PVC plastic.

10. The joint assembly of claim 8, wherein the adhesive tape backing further comprises a plurality of edges which are folded over the first flange and the second flange of each channel screed section.

11. The joint assembly of claim 6, wherein the first and second flanges include a plurality of holes for facilitating the mounting of the joint assembly.

12. The joint assembly of claim 6, wherein the first wall and the second wall of each channel screed section includes hooking means for anchoring certain surface materials such as stucco.

13. A joint assembly, comprising:

a first screed section and a second screed section, wherein each section includes a mitered end such that the mitered end of the first section abuts the mitered end of the second section, a channel bottom having a front surface and a back surface, a first channel wall extending from the front surface, and a second channel wall extending from the front surface; the channel bottom of each screed section including a first flange extending outwardly from the first channel wall and a second flange extending outwardly from the second channel wall, both flanges lying in the same plane as the channel bottom;

an adhesive tape adhered to the back surfaces of the first and second screed sections; and a hot glue for bonding the first screed section to the second screed section at the location where the sections abut.

14. The joint assembly of claim 13, wherein the adhesive tape backing further comprises a plurality of edges which are folded over the first flange and the second flange of each channel screed section.

15. The joint assembly of claim 13, wherein the first and second flanges include a plurality of holes for facilitating the mounting of the joint assembly.

16. The joint assembly of claim 13, wherein the first wall and the second wall of each channel screed section includes hooking means for anchoring certain surface materials such as stucco.

17. A method for forming a preformed screed joint assembly, comprising the steps of:

mitering an end of a first screed section and a second screed section, wherein the mitered end of the first section is formed to abut the mitered end of the second section;

positioning the first screed section and the second screed section into an abutting relationship;

adhering a backing to the first and second screed sections for water-proofing the joint assembly; and applying means for bonding the first screed section to the second screed section.

18. The method for forming the joint assembly of claim 17, wherein each screed section includes a channel bottom having a front surface and a back surface, a first channel wall extending from the front surface, and a second channel wall extending from the front surface.

19. The method for forming the joint assembly of claim 17, further comprising the step of adhering an adhesive tape to the back surfaces of the screed sections.

20. The method for forming the joint assembly of claim 17, further comprising the step of adhering an adhesive water-proof foil tape to the back surfaces of the screed sections.

21. The method for forming the joint assembly of claim 17, further comprising the step of applying hot melt glue.

22. The method for forming the joint assembly of claim 18, wherein the channel bottom of each screed section includes a first flange extending outwardly from the first channel wall and a second flange extending outwardly from the second channel wall, both flanges lying in the same plane as the channel bottom.

23. The method for forming the joint assembly of claim 22, further comprising the step of applying hot melt glue to the screed sections substantially at the locations where the screed sections abut.

24. The method for forming the joint assembly of claim 22, further comprising the step of adhering the adhesive tape to the back surfaces of the screed sections.

25. The method for forming the joint assembly of claim 22, wherein the channel screed sections are formed from PVC plastics.

26. The method for forming the joint assembly of claim 24, further comprising the step of folding a plurality of adhesive tape edges over the first flange and the second flange of each screed section.

27. The method for forming the joint assembly of claim 22, wherein the first and second flanges include a plurality of holes for facilitating the mounting of the joint assembly.

28. The method for forming the joint assembly of claim 22, wherein the first wall and the second wall of each channel screed section includes hooking means for anchoring certain surface materials such as stucco.

* * * * *